US008485945B2

(12) United States Patent
Leonhard

(10) Patent No.: US 8,485,945 B2
(45) Date of Patent: Jul. 16, 2013

(54) FULLY ADJUSTABLE INTEGRATED EXERCISE WORKSTATION

(75) Inventor: Christoph Leonhard, River Forest, IL (US)

(73) Assignee: DuoDesk LLC, River Forest, IL (US)

( * ) Notice: Subject to any disclaimer, the term of this patent is extended or adjusted under 35 U.S.C. 154(b) by 230 days.

(21) Appl. No.: 12/797,577

(22) Filed: Jun. 9, 2010

(65) Prior Publication Data

US 2011/0082014 A1 Apr. 7, 2011

Related U.S. Application Data

(60) Provisional application No. 61/248,312, filed on Oct. 2, 2009.

(51) Int. Cl.
*A63B 22/00* (2006.01)

(52) U.S. Cl.
USPC ..... 482/52; 482/57

(58) Field of Classification Search
USPC ..... 482/51, 57, 58, 59, 60, 61, 62, 63, 482/64, 65, 139, 904
See application file for complete search history.

(56) References Cited

U.S. PATENT DOCUMENTS

| | | | | |
|---|---|---|---|---|
| 4,711,448 | A * | 12/1987 | Minkow et al. | 482/100 |
| 4,753,088 | A * | 6/1988 | Harrison et al. | 66/202 |
| 5,257,701 | A * | 11/1993 | Edelson | 211/149 |
| 5,336,147 | A * | 8/1994 | Sweeney, III | 482/57 |
| 5,529,554 | A | 6/1996 | Eschenbach | |
| 5,529,555 | A | 6/1996 | Rodgers, Jr. | |
| 5,611,758 | A | 3/1997 | Rodgers, Jr. | |
| 5,807,212 | A | 9/1998 | Nelson | |
| 5,813,947 | A * | 9/1998 | Densmore | 482/51 |
| 5,833,575 | A | 11/1998 | Holslag | |
| 6,030,322 | A * | 2/2000 | Webber | 482/100 |
| 6,171,217 | B1 * | 1/2001 | Cutler | 482/57 |
| 6,224,516 | B1 * | 5/2001 | Disch | 482/54 |
| 6,241,329 | B1 * | 6/2001 | Nielsen | 312/107 |
| D490,994 | S * | 6/2004 | Schmitz et al. | D6/366 |
| 6,808,475 | B2 * | 10/2004 | Kehrbaum | 482/54 |
| 6,830,538 | B2 * | 12/2004 | Eschenbach | 482/52 |

(Continued)

FOREIGN PATENT DOCUMENTS

| | | |
|---|---|---|
| DE | 2919494 | 11/1980 |
| JP | 2007-143798 | 6/2007 |
| WO | WO 2008/013544 | 1/2008 |
| WO | WO 2011/156046 | 12/2011 |

OTHER PUBLICATIONS

T5: Product Details located at http://www.nustep.com/products/t5/details.php, 1 page, printed Jun. 3, 2010.

(Continued)

*Primary Examiner* — Stephen Crow
(74) *Attorney, Agent, or Firm* — Evan Law Group LLC

(57) ABSTRACT

An exercise workstation comprises a table assembly having a working surface, and an elliptical trainer. The elliptical trainer comprises a seat, and at least two footplates capable of elliptical motion about an axis having a horizontal component of motion greater than a vertical component of motion. A first distance between the seat and the table assembly is adjustable, a second distance between the seat and the axis is adjustable, the first distance and the second distance are independently adjustable, and the elliptical trainer is a recumbent or semi-recumbent elliptical trainer.

20 Claims, 8 Drawing Sheets

U.S. PATENT DOCUMENTS

| | | | | |
|---|---|---|---|---|
| 6,866,618 | B2 * | 3/2005 | Rusinak-Connors | 482/148 |
| 6,945,911 | B2 * | 9/2005 | Jackowski | 482/9 |
| 7,201,708 | B2 * | 4/2007 | Dreissigacker et al. | 482/57 |
| 7,249,802 | B2 * | 7/2007 | Schmitz et al. | 297/452.31 |
| 7,398,738 | B2 * | 7/2008 | Newhouse et al. | 108/147 |
| 7,419,222 | B2 * | 9/2008 | Schmitz et al. | 297/440.2 |
| 7,458,918 | B1 * | 12/2008 | Clark | 482/57 |
| 7,507,185 | B2 | 3/2009 | Eschenbach | |
| 7,614,991 | B2 * | 11/2009 | Fox | 483/54 |
| 7,648,447 | B2 | 1/2010 | Andre | |
| 7,670,269 | B2 * | 3/2010 | Webber et al. | 482/94 |
| 7,722,513 | B2 * | 5/2010 | Habing | 482/142 |
| 7,780,578 | B2 * | 8/2010 | Packham | 482/54 |
| 7,892,148 | B1 * | 2/2011 | Stauffer et al. | 482/54 |
| 7,892,150 | B1 * | 2/2011 | Colley | 482/54 |
| 7,908,981 | B2 * | 3/2011 | Agee | 108/147 |
| 2002/0043909 | A1 * | 4/2002 | Nielsen | 312/237 |
| 2002/0061804 | A1 | 5/2002 | Hasegawa | |
| 2002/0098960 | A1 | 7/2002 | Rusinak-Connors | |
| 2002/0151415 | A1 * | 10/2002 | Hildebrandt et al. | 482/57 |
| 2002/0160883 | A1 | 10/2002 | Dugan | |
| 2004/0014566 | A1 * | 1/2004 | Kao | 482/8 |
| 2005/0054492 | A1 | 3/2005 | Neff | |
| 2006/0247109 | A1 * | 11/2006 | Powell | 482/148 |
| 2006/0258513 | A1 * | 11/2006 | Routley et al. | 482/54 |
| 2007/0117680 | A1 * | 5/2007 | Neff et al. | 482/8 |
| 2007/0123390 | A1 | 5/2007 | Mathis | |
| 2008/0085819 | A1 * | 4/2008 | Yang | 482/62 |
| 2008/0096745 | A1 * | 4/2008 | Perry | 482/148 |
| 2008/0234111 | A1 | 9/2008 | Packham | |
| 2008/0314851 | A1 | 12/2008 | Jacoby | |
| 2009/0221936 | A1 * | 9/2009 | Levine et al. | 600/595 |
| 2010/0071115 | A1 * | 3/2010 | Sadato | 2/243.1 |
| 2011/0237396 | A1 * | 9/2011 | Lu | 482/1 |
| 2012/0065034 | A1 * | 3/2012 | Loach | 482/116 |

OTHER PUBLICATIONS

Treadmill Desk, located at http://www.treadmill-desk.com/2007/06/inspiration_02.html, 2 pp. (2007).

TrekDesk, located at http://www.trekdesk.com/index.html, 1 page, printed on Sep. 2, 2010.

TreadDesk, located at http://www.treaddesk.com/home.html, 1 page, printed on Sep. 2, 2010.

"Non-Exercise Activity Thermogenesis", available at http://mayoresearch.mayo.edu/Levine_lab/about.cfm, 2 pp., printed on Sep. 2, 2010.

Walkstation, located at http://www.steelcase.com/en/products/category/tables/adjustable/walkstation/pages/overview.aspx, 2 pp., printed on Sep. 2, 2010.

Body Charger Brochure, Gee Hoo Industrial Corp. Gee Hoo Fitec Corp., 40 pp., (2002-2003).

Steelcase, located at http://www.peppercom.com/casestudies/steelcase, 1 page, printed on Oct. 29, 2010.

Mlive, Walkstation, located at http://www.mlive.com/business/west-michigan/index.ssf/2008/06/steelcase_unit_eyes_retail_net.html, 1 page, printed on Oct. 29, 2010.

Straker, L. et al., "The effects of walking and cycling computer workstations on keyboard and mouse performance", Human Factors: The Journal of the Human Factors and Ergonomics Society, vol. 51, No. 6, pp. 831-844, (2009).

Levine, J. A. et al., "Non-exercise activity thermogenesis the crouching tiger hidden dragon of societal weight gain", Arterioscler Thromb Vasc Biol, vol. 26, pp. 729-736, (2006).

Invitation to Pay Additional Fees and Partial Search Report dated Aug. 16, 2011 for PCT/US2011/030658.

International Search Report dated Mar. 19, 2012 for PCT application No. PCT/US2011/030658.

* cited by examiner

FULLY ADJUSTABLE INTEGRATED EXERCISE WORKSTATION

REFERENCE TO RELATED APPLICATIONS

This application claims the benefit of U.S. Provisional Application No. 61/248,312 entitled "Fully Adjustable Integrated Desk Exercise Machine" filed Oct. 2, 2009, which is incorporated by reference in its entirety, except where inconsistent with the present application.

BACKGROUND

Automation and technological convenience have transformed previously active and ambulatory persons across the globe into increasingly sedentary beings. This trend is particularly prevalent in the workplace, where employees are often required to spend up to 8 hours a day seated at a desk, with their only substantial physical activity consisting of an occasional trip to the water cooler. When coupled with a diet of high calorie soft drinks and energy-dense, processed foods, increasingly sedentary lifestyles have led to an obesity epidemic, particularly in countries such as the United States. Many have proposed methods and devices to increase physical activity in the workplace. Few, however, have seen widespread adoption or commercial success.

For example, an exercise desk, at which the user works while walking on a treadmill, has been described by Densmore (U.S. Pat. No. 5,813,947). However, the height of the desk is not adjustable, and thus it cannot safely accommodate users of different heights. In addition, walking on a treadmill while performing anything but the simplest of office tasks is impractical. The up and down motion created by walking destabilizes the upper torso, substantially impairing fine motor coordination and making it difficult to write or type.

Due to the nature of walking on a treadmill, it is difficult to maintain a consistent distance from the desk, further increasing the difficulty of office tasks and requiring additional cognitive resources to constantly adjust his or her walking speed. The user must also concern him or herself with balancing and with avoiding tripping on the treadmill. These issues are only exacerbated when the incline of the treadmill is increased. Furthermore, it is unreasonable to require the user to stand and walk for an entire workday; many are unable to do so without joint soreness or unacceptable levels of perspiration. Consequently, the design fails to provide an exercise which can be sustained throughout the workday. Finally, because the intensity of exercise cannot be increased without increasing walking speed or increasing the incline, the design of Densmore cannot effectively accommodate users of different fitness levels.

The exercise devices described by Neff (US App. 2005/0054492) and Edelson (U.S. Pat. No. 5,257,701) suffer from similar shortcomings. Edelson describes a stationary bicycle operated at a desk. However, operation of a stationary bicycle produces an abrupt up and down motion of the legs, which, similar to the operation of a treadmill, destabilizes the upper torso. Operation of the stationary bicycle also prevents movement of the seat to a comfortable position with respect to the edge of the desk. Should the user be positioned too close to the desk, the knees are likely to collide with the bottom of the desk. Others have remedied this issue by raising the height of the desk, to prevent such collisions; however, raising the height of the desk to an uncomfortable position is impractical for users who wish to operate the exercise device for up to 8 hours a day. Finally, the stationary bicycle described by Edelson requires the user to grasp handles in order to prevent being propelled away from the desk, preventing the user from accomplishing work tasks which utilize the user's hands.

SUMMARY

In a first aspect, the present invention is an elliptical trainer, comprising a seat assembly, having a seat back and a seat cushion, and at least two pedals, rotatably connected to the seat assembly. The at least two foot pedals rotate in an elliptical motion in which the horizontal component of the motion is greater than the vertical component of motion, the seat back moves with respect to the seat cushion to adjust the seat depth, and the seat assembly comprises a non-electrostatic fabric.

In a second aspect, the present invention is an integrated exercise workstation, comprising an elliptical trainer and a table assembly. The elliptical trainer comprises a seat assembly, having a seat back and a seat cushion, and at least two foot pedals rotatably connected to the seat assembly. The at least two foot pedals rotate in an elliptical motion in which the horizontal component of the motion is greater than the vertical component of motion. The distance between the elliptical trainer and the seat assembly is adjustable, and the seat back moves with respect to the seat cushion to adjust the seat depth.

In a third aspect, the present invention is an integrated exercise workstation, comprising an elliptical trainer and a table assembly. The elliptical trainer comprises a seat assembly, having a seat back and a seat cushion, and at least two foot pedals rotatably connected to the seat assembly. The at least two foot pedals rotate in an elliptical motion in which the horizontal component of the motion is greater than the vertical component of motion. The table assembly includes a cross support which is located no more than 6 inches from the operating surface. The distance between the elliptical trainer and the seat assembly is adjustable, the seat back moves with respect to the seat cushion to adjust the seat depth, and the seat assembly comprises a non-electrostatic fabric. The height of the surface of the table assembly is adjustable.

In a fourth aspect, the present invention is a low step height integrated exercise workstation, comprising a seat assembly, a table assembly, and an elliptical trainer. The elliptical trainer comprises at least two foot pedals which rotate in an elliptical motion in which the horizontal component of the motion is greater than the vertical component of motion. The mechanical components of the elliptical trainer are located in front of the user, when the user is seated on the seat assembly. The seat assembly is connected to the elliptical trainer and/or table assembly, and the distance from the seat assembly to the at least two foot pedals is adjustable.

In a fifth aspect, the present invention is a low step height integrated exercise workstation, comprising a seat assembly, a table assembly, and an elliptical trainer. The elliptical trainer comprises at least two foot pedals which rotate in an elliptical motion in which the horizontal component of the motion is greater than the vertical component of motion. The mechanical components of the elliptical trainer are integrated into the table assembly. The seat assembly is connected to the table assembly, and the distance from the seat assembly to the at least two foot pedals is adjustable.

DETAILED DESCRIPTION

The present invention makes use of the discovery of an integrated exercise workstation which permits users to perform work-related tasks while simultaneously increasing thermogenesis. In particular, the present invention takes advantage of an elliptical foot motion which mimics walking. Consequently, operation of the integrated exercise workstation requires no additional cognitive resources, enabling the user to direct his or her attention to work-related activities. Additionally, performing the elliptical foot motion while seated in a recumbent or semi-recumbent position allows the user to engage in low-intensity physical exercise while retaining upper torso stability and fine motor coordination. Preferably, the horizontal component of elliptical foot motion is greater than the vertical component of elliptical foot motion, enabling ergonomic placement of the work surface.

The present invention makes use of a form of low impact exercise known as "Non-Exercise Activity Thermogenesis" (NEAT). The amount of energy expenditure which can be attributed to NEAT can vary widely from individual to individual. For instance, the NEAT values of persons with highly ambulatory occupations may be up to 1,000 kcal/day higher than those with sedentary occupations [1]. Testing of the present invention has shown that, depending on fitness level, users of the integrated exercise workstation readily increase their NEAT values by between 100 kcal and 200+ kcal per hour, without noticeable effort or perspiration. Even novice users with no prior history of exercising were able to operate the apparatus for extended periods of time. Thus, over the course of an 8-hour work day, the present invention enables users to burn an additional 800 kcal to 1600+ kcal per day.

The phrase "elliptical motion" means movement of an object along a plane curve such that the sums of the distances from each point along the curve to two fixed points, the foci, are equal.

Figure 1:
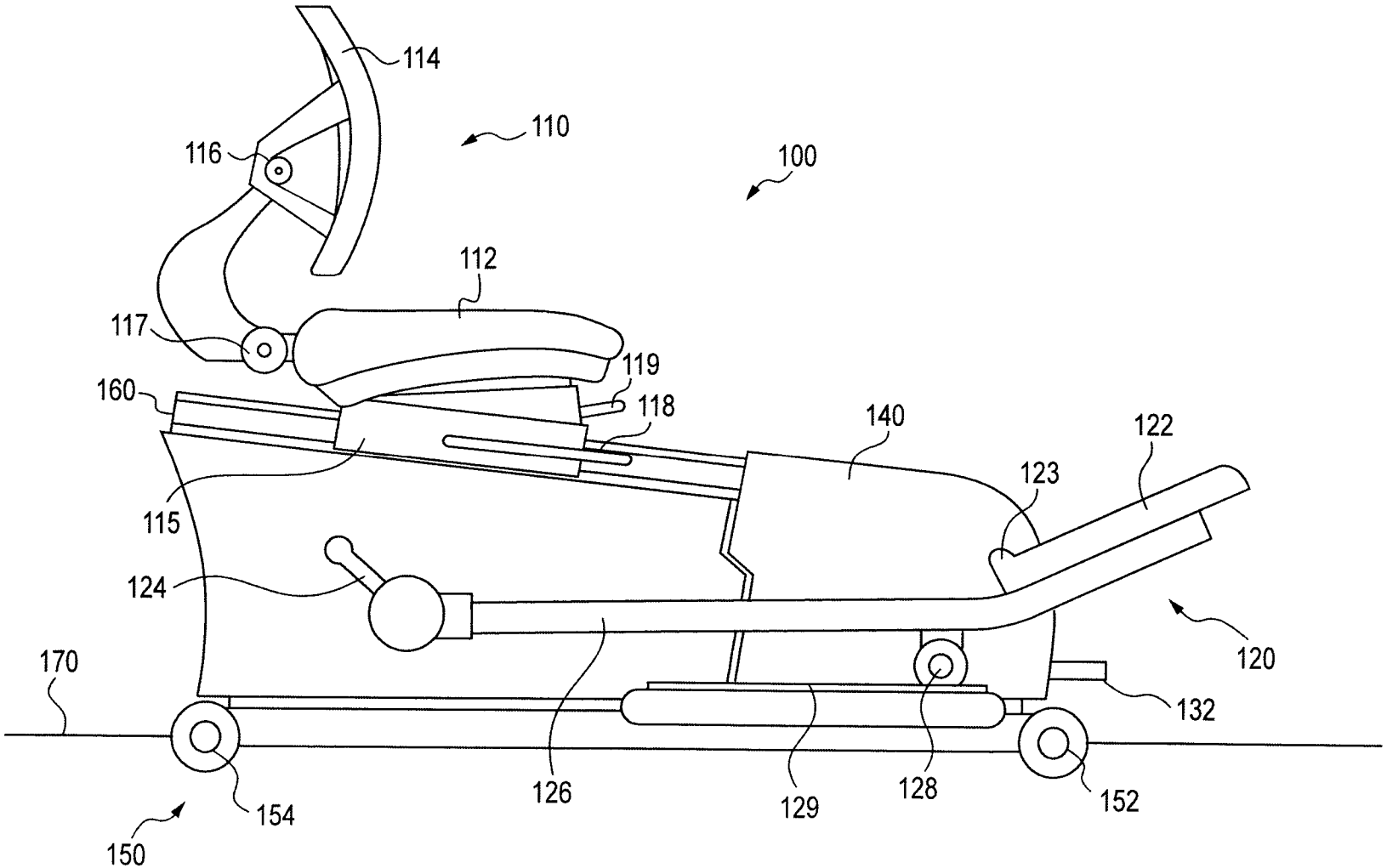
FIG. 1 illustrates an elliptical trainer.
Figure 2:
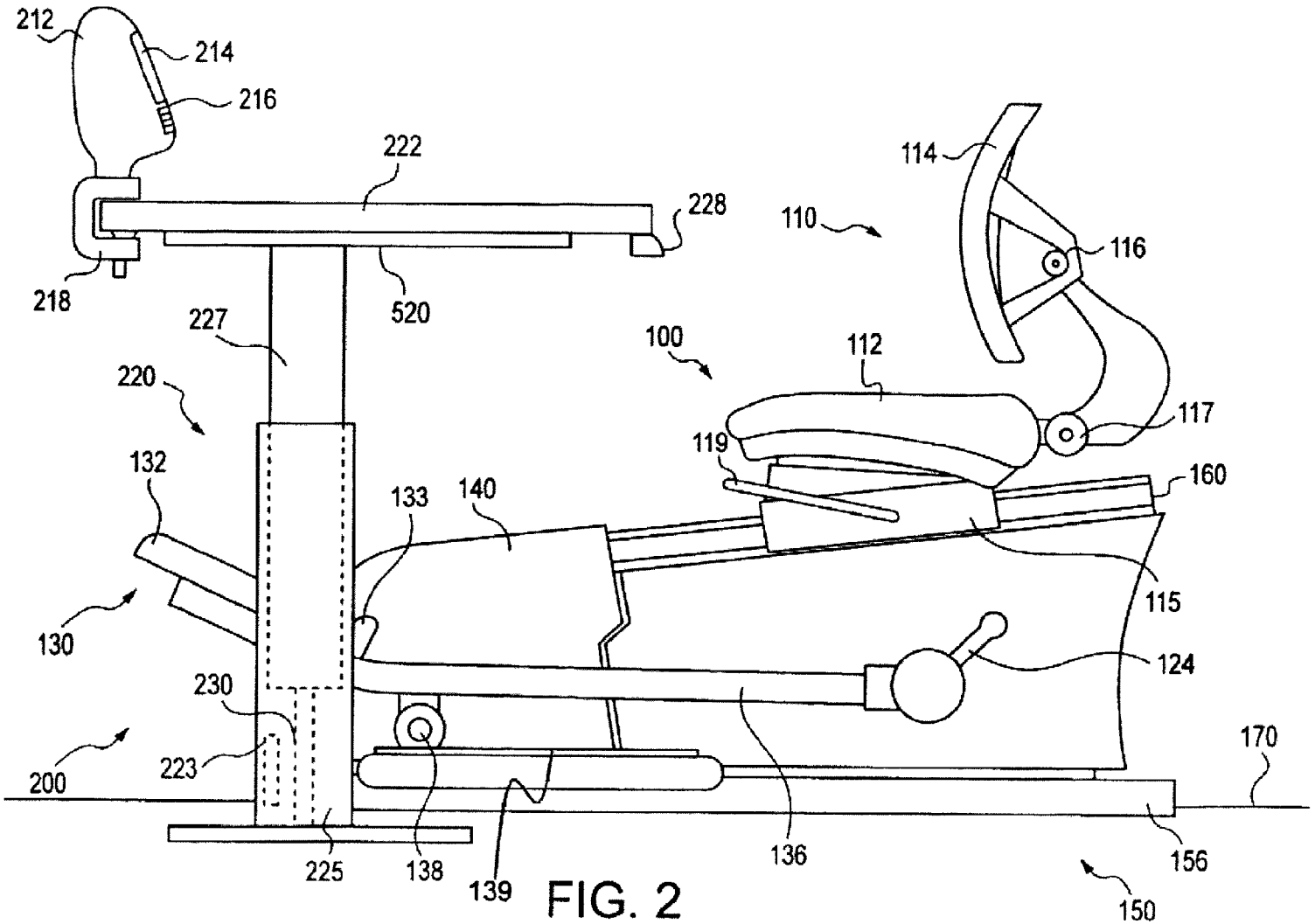
FIG. 2 illustrates an integrated exercise workstation.

The phrase "stride height" means the vertical distance from the highest position of the user's ankle to the lowest position of the user's ankle during exercise, when the back of the user's feet are positioned against the right and left rear lips 123 and 133 of the right and left the footplates 122 and 132, as illustrated in FIGS. 1 and 2.

The phrase "low step height" means that the height of the lowest point between the seat and the footplates of the integrated exercise workstation is at most 10 inches. This height is measured from the operating surface which surrounds the integrated exercise workstation.

The term "recumbent" means a posture in which an individual is reclined while seated on their backside with their legs at least partially extended forward.

The term "semi-recumbent" means a posture in which an individual is seated in an upright or nearly upright position with their legs at least partially extended forward.

The phrase "non-electrostatic fabric" means fabric which resists the accumulation of static electricity or which facilitates the removal of static electricity, for example, through conduction.

The phrase "seat depth" means the length of the portion of the seat cushion on which a user can comfortably sit. The seat depth is measured from the end of the seat cushion over which the user's legs hang to a vertical line intersecting with the seat cushion, drawn from the plane of the seat back against which the user's back rests.

The term "thermogenesis" means the production of heat in a living organism by physiological processes.

The phrase "heart rate" means the number of heart beats experienced by a user per minute. The phrase "maximum heart rate" is defined as follows: for males, the maximum heart rate in beats per minute is [210−0.5*(user age)−0.01*(user body weight in pounds)+4]; for females, the maximum heart rate in beats per minute is [210−0.5*(user age)−0.01*(user body weight in pounds)].

The phrase "office work" means activities which involve fine hand coordination, such as, for example, typing, writing, or drawing.

The design of the integrated exercise workstation permits the user to engage in low-intensity exercise while maintaining the ability to effectively complete work tasks, for instance, at an office desk. Because the lower torso is supported by a seat, the upper torso remains still, allowing the user to maintain a "steady hand" for office work. In addition, because the seat supports the user's body weight, the user can engage in low intensity exercise, without sweating, for extended periods of time. The working surface is preferably located at or near the elbow level of the user, when the user's arms are resting vertically at the user's sides. This configuration allows the user to perform work tasks, such as writing and typing, just as they would be performed at a standard office desk. In order to accommodate placement of the working surface at elbow level, while still allowing for exercise without obstruction, the elliptical trainer preferably includes several important design considerations.

Significantly increasing energy expenditure and muscle strength through physical exercise requires the utilization and movement of large muscle groups. Office work, however, requires an individual to maintain fine motor coordination in order to perform common work-related activities such as writing and typing. It has been discovered that, by utilizing an elliptical foot motion, the intensity of exercise can be adjusted to accommodate users of varying fitness levels, without requiring the user to engage in an exercise which will destabilize the upper torso and impair fine motor coordination. Unlike treadmills, for which the speed and/or incline must be increased, the elliptical trainer described in an embodiment of the invention permits the user to increase exercise intensity by increasing the resistance to the foot pedals. By simply increasing resistance, and not increasing the speed or incline at which the exercise is performed, the integrated exercise workstation can challenge users of varying fitness levels without requiring them to engage in exercises which will destabilize their upper torso and prevent them from effectively performing their work tasks.

Traditionally, it is recommended that, during exercise, the heart rate not exceed 85 percent of the maximum heart rate, to maximize the cardiovascular benefits. Optimal fat burning is believed to occur during exercise which maintains the heart rate at 65 percent of the maximum heart rate. As a result, traditional exercise equipment is designed for exercise which elevates the heart rate to at least 65 percent of the maximum heart rate. However, because it is likely to cause significant perspiration, such high intensity exercise is inappropriate for the workplace. Preferably, when operating the integrated exercise workstation, the highest heart rate achieved is at most 60 percent of the maximum heart rate of the user. By maintaining a heart rate of at most 60 percent of the maximum heart rate, most users can avoid significant perspiration. More preferably, the highest heart rate achieved is at most 55 percent of the maximum heart rate of the user. Even more preferably, the highest heart rate achieved is at most 50 percent of the maximum heart rate of the user. Even more preferably, the highest heart rate achieved is at most 45 percent of the maximum heart rate of the user.

During exercise, the user moves his or her feet in an elliptical motion in which the horizontal component of the motion is greater than the vertical component of motion. Exercise machines in which the horizontal and vertical components of foot motion are equal, such as stationary bikes, cause the user to rock back and forth during operation, even when operated at low speeds. This rocking motion is transmitted to the user's upper torso, making it difficult to perform tasks requiring fine motor coordination. As a result, it is preferable that the feet move in an elliptical motion in which the horizontal component of the motion is greater than the vertical component of motion. By reducing the vertical component of leg movement, stability of the upper torso is increased, allowing the user to effectively perform work-related tasks.

Preferably, the elliptical trainer has a low stride height. During operation, the user's feet, placed upon the footplates, move in an elliptical motion. This elliptical motion has a horizontal component and a vertical component. If the vertical component of the elliptical motion is too high, the knees will collide with the working surface when the working surface is positioned at a comfortable level, for example, at elbow level. In addition, the upper torso becomes destabilized, resulting in a loss of fine motor coordination. If, on the other hand, the vertical component of the elliptical motion is too low, or is removed entirely, the exercise will not target the large muscles groups in the user's legs, preventing the user from increasing muscle tone and strength and decreasing the amount of calories burned by the user. Thus, the elliptical trainer preferably has a low stride height. This low stride height permits comfortable placement of the working surface and allows the user to maintain fine motor coordination during exercise. Preferably, the stride height is 20 cm or less. More preferably, the stride height is 12 cm or less. Even more preferably, the stride height is 5 cm or less.

Because the seat assembly may also function as the user's primary office seat, on which the user will spend a large portion each day, comfort and proper adjustment is important. Specifically, it is important that the user's knees are properly positioned over the end of the seat cushion. If the depth of the seat cushion is too short, the user's knees will be positioned too far in front of the end of the seat cushion, causing the seat cushion to "dig" into the user's hamstrings. If the depth of the seat cushion is too long, the end of the seat cushion will uncomfortably align with the calves, and the user will be unable to properly bend their knees. Accordingly, in order to permit the user to comfortably sit on the seat assembly for an entire workday, the depth of the seat cushion is preferably adjustable. In one embodiment, illustrated in FIG. 1, by operating the depth toggle 119, a user can adjust the position of the seat back 114 with respect to the seat cushion 112. Upon activating the depth toggle 119, the seat back 114 pivots about the depth pivot 117, allowing the user to lengthen or shorten the distance from the seat back 114 to the end of the seat cushion 112. Any resulting change in the angle of the seat back 114 is compensated for by the angle pivot 116.

During exercise, friction is produced by movement of the legs. When exercise is performed over an extended period of time, static electricity may buildup. Static electricity buildup is particularly likely in dry climates and during the winter months. In a typical gym setting, the effects of such buildup are negated by perspiration. However, during testing of the integrated exercise workstation, it was discovered that friction produced by movement of the legs led to a buildup of static electricity. This buildup caused a painful electric shock when metal objects are touched and has the potential to damage electronic devices. Thus, preferably, the seat cushion and/or the seat back are covered with a non-electrostatic fabric. Preferably, this fabric is conductive, so that static electricity is conducted away and does not buildup.

FIG. 1 illustrates an elliptical trainer 100 having aspects of the present invention. The elliptical trainer 100 includes a seat assembly 110, right and left elliptical foot assemblies 120 and 130, a body 140, a transport assembly 150, and a slide rail 160. The seat assembly 110 includes a seat cushion 112, a seat back 114, a rail assembly 115, an angle pivot 116, a depth pivot 117, a distance toggle 118, and a depth toggle 119. The right elliptical foot assembly 120 includes a right footplate 122, a right rear lip 123, a crankshaft 124, a right rocker 126, a right pivot wheel 128, and a right wheel guide 129. The transport assembly 150 includes front transport wheels 152 and rear transport wheels 154.

The seat cushion 112 is mechanically coupled to the rail assembly 115. The seat back 114 is pivotably connected to the seat cushion 112 by the angle pivot 116 and the depth pivot 117. The rail assembly 115 is slidably connected to the slide rail 160. The distance toggle 118 is mechanically coupled to the rail assembly 115 and the slide rail 160. The depth toggle 119 is mechanically coupled to the depth pivot 117. The right footplate 122 is mechanically coupled to the right rocker 126. The right rocker 126 is rotatably connected to the crankshaft 124. The right pivot wheel 128 is mechanically coupled to the right rocker 126. The right pivot wheel 128 is in contact with the right wheel guide 129. The front and rear transport wheels 152 and 154 are rotatably connected to the body 140 and are in contact with an operating surface 170. The slide rail 160 is mechanically coupled to the body 140.

In operation, the seat back 114 pivots about the angle pivot 116 in order to adjust the angle of the seat back 114. The distance toggle 118 allows the user to control the distance from the seat cushion 112 to the right and left footplates 122 and 132. Such adjustment allows the elliptical trainer 100 to comfortably accommodate users of heights of approximately 5' to 6' 5". When the user pulls the distance toggle 118 in a counterclockwise motion, the rail assembly 115 slides freely along the slide rail 160. Once the user releases the distance toggle 118, the rail assembly 115 locks into one of a series of positions along the slide rail 160. The depth toggle 119 allows the user to control the depth of the seat cushion 112 by controlling the position of the seat back 114 relative to the seat cushion 112. When the user pulls the depth toggle 119 in a counterclockwise motion, the seat back 114 and angle pivot 116 freely rotate about the depth pivot 117. Rotation about the depth pivot 117 in a clockwise manner decreases the depth of the seat cushion 112, while rotation in a counterclockwise manner increases the depth of the seat cushion 112. Once the user releases the depth toggle 119, the position of the seat back 114 with respect to the seat cushion 112 becomes fixed.

Traditionally, exercise equipment is covered with a non-porous material, such as, for example, vinyl or leather, so that the equipment can be easily wiped clean. Such materials impair the transfer of heat and/or moisture away from the user. The seat cushion 112 and/or seat back 114 are preferably covered with a porous, non-electrostatic fabric. The non-electrostatic fabric is preferably a conductive or lightly conductive fabric. During operation of the elliptical trainer 100, static electricity produced between the elliptical trainer 100 and the user and/or between the legs of the user travels into the seat cushion 112 and seat back 114 fabrics, preventing the buildup of static electricity on the user. In addition, the fabrics of the seat cushion 112 and/or seat back 114 are preferably porous so that heat and moisture generated during exercise are transferred away from the user. Even more preferably, the fabrics of the seat cushion 112 and/or seat back 114 are mesh fabrics through which the surrounding air can travel, thus further transferring heat and moisture away from the body of the user and decreasing user perspiration. In an alternative embodiment, the fabric of the seat cushion 112 and/or seat back 114 may be coated with a nano-particle electrostatic shielding to prevent static buildup.

During operation of the elliptical trainer 100, the user is in a recumbent or semi-recumbent position. The user's feet, placed upon the right and left footplates 122 and 132, move in an elliptical motion. The right and left rockers 126 and 136 then rock forward and backward while pivoting upon the right and left pivot wheels 128 and 138, causing the crankshaft 124 to rotate in a circular motion. The right and left pivot wheels roll forwards and backwards along the right and left wheels guides 129 and 139. Preferably, the elliptical motion of the right and left footplates 122 and 132 is an elliptical motion in which the horizontal component of the motion is greater than the vertical component of motion.

The front and rear wheels 152 and 154 of the transport assembly 150 are in contact with, and roll along, the operating surface 170, allowing the user to easily move the elliptical trainer 100 forwards and backwards. Unlike traditional exercise equipment, for which immobility is desired, the mobility of the elliptical trainer 100 allows the user to easily position it at a comfortable distance from the table assembly 220. Comfortable placement of the elliptical trainer with respect to the table assembly 220 is important, since the user may operate the elliptical trainer 100 for the majority of the work day. Additionally, the mobility provided by the transport assembly 150 enables the user to more easily mount and dismount the elliptical trainer 100. When the user desires to dismount the elliptical trainer 100, the elliptical trainer 100 can be easily moved away from the table assembly 220. In an alternative embodiment, the elliptical trainer 100 slides along a track 156, which runs under the table assembly 220.

Preferably, the footprint of the integrated exercise workstation is the same as that of a standard office desk. Because the integrated exercise workstation is used on a daily basis, for up to 8 hours per day, the elliptical trainer and table assembly are preferably commercial quality components. Consequently, the use of high strength materials and professional quality construction is preferable. In addition, the integrated exercise workstation is preferably quiet during operation, so that others in the workplace are not distracted by its use. This objective may be accomplished by ensuring that quality materials are used and constructed in a manner which reduces friction and vibrations. Preferably, the integrated exercise workstation also includes materials which dampen sound and vibrations.

In another embodiment, the seat assembly 110 rotates clockwise and/or counterclockwise about a vertical or substantially vertical axis, in order to allow less mobile users, such as elderly or obese users, to more easily mount and dismount the elliptical trainer 100. For instance, when a user desires to mount the elliptical trainer, he or she can rotate the seat assembly 110 to the left or right side of the machine. Once the user is sitting on the seat assembly 110, the seat assembly 110 can be rotated back into the exercise position.

FIG. 2 illustrates an elliptical trainer 100 and a workstation 200 having aspects of the present invention. The elliptical trainer 100 includes a left elliptical foot assembly 130 and a transport assembly 150. The left elliptical foot assembly 130 includes a left footplate 132, a left rear lip 133, a left rocker 136, a left pivot wheel 138, and a left wheel guide 139. The transport assembly 150 includes a track 156. The workstation 200 includes an optional display console 210 and a table assembly 220. The display console 210 includes a console body 212, a screen 214, a keypad 216, and a mounting bracket 218. The table assembly 220 includes a working surface 222, a cross support 223, a right static column 224, a left static column 225, a right moving column 226, a left moving column 227, a height adjustment interface 228, a right telescopic assembly 229, and a left telescopic assembly 230.

The left footplate 132 is mechanically coupled to the left rocker 136. The left rocker 136 is rotatably connected to the crankshaft 124. The left pivot wheel 138 is mechanically coupled to the left rocker 136. The left pivot wheel 138 is in contact with the left wheel guide 139. The track 156 is in contact with the operating surface 170 and is slidably connected to the body 140.

The working surface 222 is mechanically coupled to the right and left moving columns 226 and 227. The right and left moving columns 226 and 227 are slidably connected to the right and left static columns 224 and 225, respectively. The right and left static columns 224 and 225 are in contact with the operating surface 170. The right and left telescopic assemblies 229 and 230 are mechanically coupled to the right and left static columns 224 and 225, respectively. The right and left telescopic assemblies 229 and 230 are threaded into the right and left moving columns 226 and 227. The cross support 223 is mechanically coupled between the right and left static columns 224 and 225. The height adjustable interface 228 is mechanically coupled to the underside of the working surface 222 and is in electrical communication with the right and left telescopic assemblies 229 and 230. The keypad 216 is in communication with the screen 214 via internal electronics. The keypad 216 and screen 214 are housed within the console body 212. The console body 212 is mechanically coupled to the mounting bracket 218. The mounting bracket 218 is mechanically coupled to the working surface 222. The display console 210 is in communication with the data port 514 of the elliptical trainer 100 via internal electronics.

Preferably, the display console 210 is not fixed to the elliptical trainer 100. Rather, the display console 210 is preferably attached to the working surface 222 of the table assembly 220. Such placement allows the user to easily view exercise data without turning away from his or her work tasks. Additionally, placement on the working surface 222 of the table assembly 220 enables the user to easily mount and dismount the seat assembly 110 of the elliptical trainer 100, as well as easily operate the distance and depth toggles 118 and 119, without obstruction. The display console 210 may be attached to the working surface 222 by a mounting bracket 218. In one embodiment, the mounting bracket 218 is a Video Electronics Standards Association (VESA) Mounting Interface Standard (MIS), or VESA mount. For example, the mounting bracket 218 may be a VESA MIS-D 75, which attaches to the rear portion of the display console 210.

The cross support 223 is preferably attached near the base of the right and left static columns 224 and 225. Such low placement of the cross support 223 allows the elliptical trainer 100 to be positioned under the table assembly 220 without the right and left footplates 122 and 132 striking the cross support 223. Placement of the elliptical trainer 100 under the table assembly 220 enables the user to be positioned at a comfortable distance from the working surface 222 of the table assembly 220. In order to prevent collision of the footplates with the cross support 223, the bottom edge of the cross support 223 is preferably positioned no more than 18 inches above the operating surface 170. Even more preferably, the bottom edge of the cross support 223 is positioned no more than 12 inches above the operating surface 170. Even more preferably, the bottom edge of the cross support 223 is positioned no more than 6 inches above the operating surface 170. Such placement of the cross support 223 ensures that the table assembly 220 has sufficient lateral stability and is not vulnerable to torsion forces, but does not interfere with operation of the elliptical trainer 100.

In another embodiment, the table assembly 220 is a four-legged table. By using a four-legged table, there is no need for a cross support, and, while the user is exercising, the right and left footplates 122 and 132 of the elliptical trainer 100 can move without obstruction.

In a preferred embodiment, the table assembly 220 includes a cable management system 520. In one aspect, this cable management system 520 includes a conduit through which cables, including, for example, computer cables, telephone cables, or power cables, are routed in order to prevent such cables from obstructing the path of the right and left footplates 122 and 132 and the right and left rockers 126 and 136 of the elliptical trainer 100. Preferably, this conduit travels along the underside of the working surface 222 of the table assembly 220 and/or along one or both of the columns. In an alternative embodiment, the cable management system 520 includes wire harnesses which route cables along the underside of the working surface 222 and/or along one or both of the columns.

In operation, the elliptical trainer 100 can be easily moved along the track 156 in order to position the elliptical trainer 100 closer to or further away from the table assembly 220. The user adjusts the height of the working surface 222 by operating the height adjustment interface 228. The height adjustment interface 228 then sends an electrical signal to the right and left telescopic assemblies 229 and 230, which move the right and left moving columns 226 and 227 up or down. In an alternative embodiment, the height of the working surface 222 of the table assembly 220 is adjusted by a hand crank. The hand crank is mechanically coupled to the right and left telescopic assemblies 229 and 230 such that rotation of the hand crank in one direction raises the right and left moving columns 226 and 227, while rotation of the hand crank in the other direction lowers the columns. Such a configuration could be used to reduce the production cost of the integrated exercise workstation.

As the user operates the elliptical trainer 100, exercise data is transmitted from the elliptical trainer 100 to the display console 210. The exercise data, including, for example, rotations per minute (RPM), calories burned, distance traveled, and heart rate are displayed on the screen 214. By operating the keypad 216, the user can input personal variables, including, for example, physiological variables such as age, height, and weight. Additionally, the user can control the exercise intensity by operating the keypad 216. User data is transmitted from the display console 210 to the elliptical trainer 100.

Exercise and office work can be performed simultaneously at the integrated exercise workstation. Preferably, exercise and office work can be performed simultaneously for at least two hours within a ten hour period. More preferably, exercise and office work can be performed simultaneously for at least four hours within a ten hour period. Even more preferably, exercise and office work can be performed simultaneously for at least six hours within an eight hour period. The simultaneous performance may be discontinuous. For instance, exercise and office work may be simultaneously performed for multiple individual segments of time, which, when added together, total at least two hours within a ten hour period, at least four hours within a ten hour period, or at least six hours within a eight hour period.

In one embodiment, the working surface 222 of the table assembly 220 is horizontally adjustable. This adjustability allows the user to move the working surface 222 towards or away from the seat assembly 110 while the columns of the table assembly 220 remain stationary. In one embodiment, the working surface 222 slides on ball bearings, and the horizontal position of the working surface 222 is adjusted manually. In another embodiment, the working surface 222 is mechanically coupled to a slide rail. In yet another embodiment, the horizontal position of the working surface 222 is adjusted by an electric motor, which is controllable by the user.

In another embodiment, the height of the seat cushion 112 can be adjusted separately from the distance from the seat cushion 112 to the right and left footplates 122 and 123. Such adjustment raises or lowers the seat cushion 112 with respect to the slide rail assembly 160 without altering the distance from the seat cushion 112 to the footplates. In one embodiment, such height adjustment is accomplished by a pneumatic seat height adjustment. In another embodiment, the height adjustment is accomplished by installing larger or smaller spacers below the seat cushion 112. In another embodiment, the seat height is electronically controlled, and the seat cushion 112 is raised and lowered by an electric motor.

In an alternative embodiment, user data and/or exercise data is transmitted from the display console 210 to a personal wireless device carried by the user, such as a mobile telephone. Alternatively, user data and/or exercise data is transmitted from the elliptical trainer 100 to a personal wireless device. The transmission of data between the display console 210 and the elliptical trainer 110, between the display console 210 and the personal wireless device, or between the elliptical trainer 100 and the personal wireless device may be accomplished through a data cable, such as, for example, a universal serial bus (USB) cable, or the data transfer may be accomplished wirelessly, such as, for example, by radio frequency (RF) communication.

In one embodiment, the display console 210 is mounted on the working surface 222 of the table assembly 220, and data is transmitted wirelessly between the display console 210 and the elliptical trainer 100. The wireless transmission of data, as opposed to the wired transmission of data, permits the right and left footplates 122 and 132 and the right and left rockers 126 and 136 to operate without the obstruction of a data cable connected from the display console 210 to the elliptical trainer 100.

Figure 3:
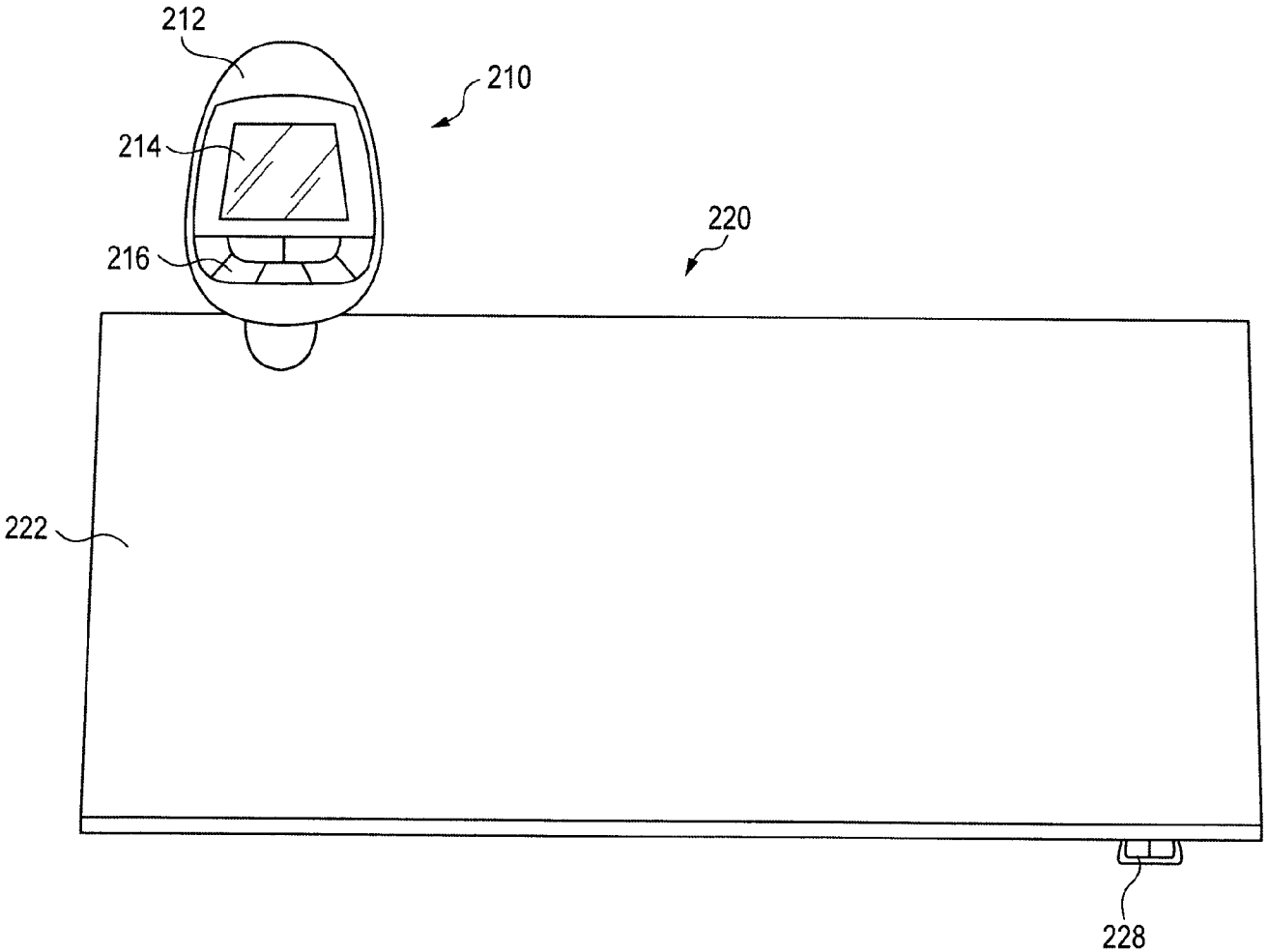
FIG. 3 illustrates a table assembly having a display console.

FIG. 3 illustrates a table assembly 220 and display console 210 having aspects of the present invention. The table assembly includes a working surface 222 and a height adjustment interface 228. The display console 210 includes a console body 212, a screen 214, a keypad 216, and a mounting bracket 218.

In a preferred embodiment, the table assembly 220 is a NEWHEIGHTS™ Electric Height Adjustable Table produced by RIGHTANGLE™ Ergonomic Products (Schofield, Wis.). Preferably, the working surface 222 of the table assembly 220 is at least 400 square inches. More preferably, the working surface 222 of the table assembly 220 is at least 800 square inches. Even more preferably, the working surface 222 of the table assembly 220 is at least 1600 square inches.

Figure 4:
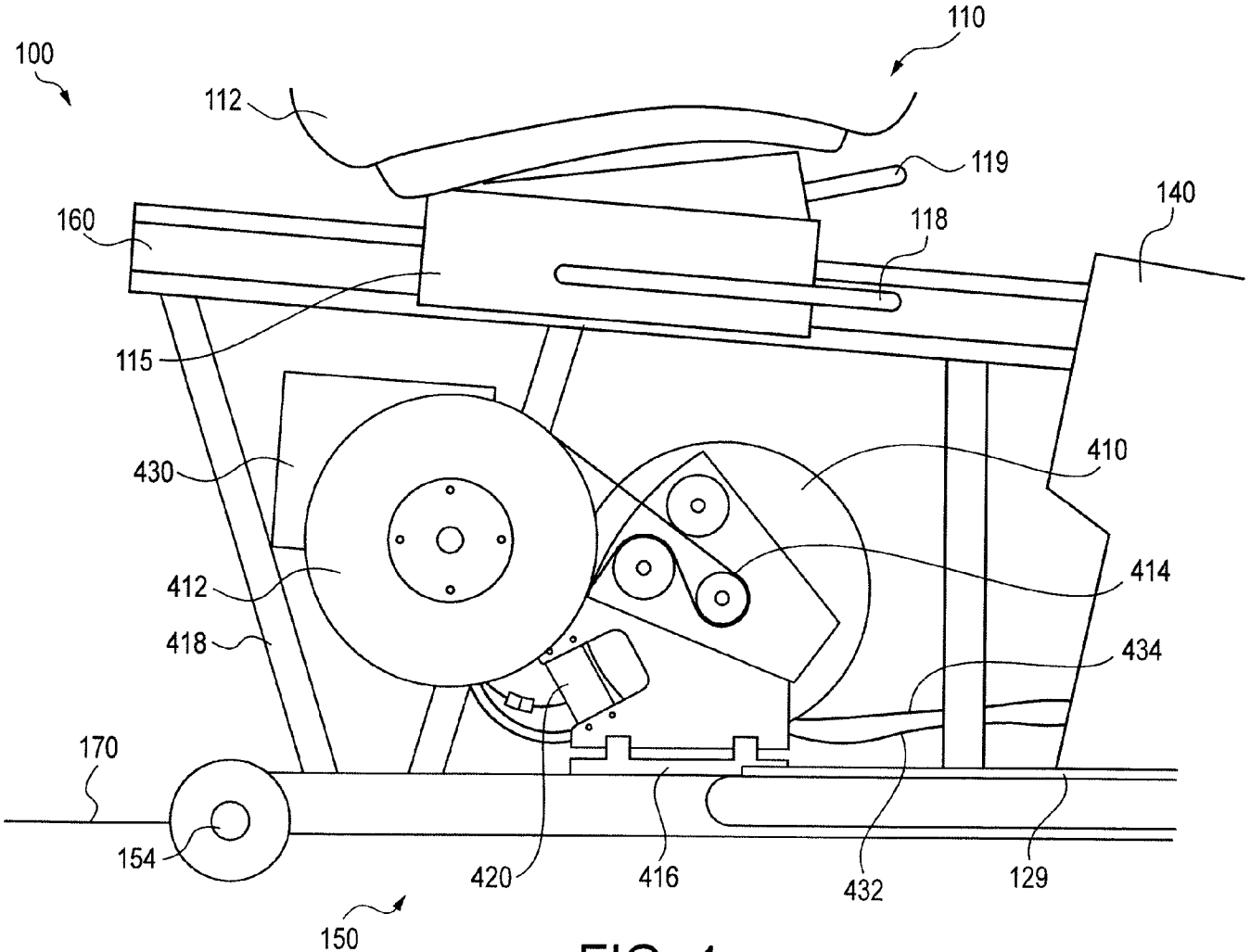
FIG. 4 illustrates the internal mechanical components of an elliptical trainer.

FIG. 4 illustrates an elliptical trainer 100, with a panel of the body 140 removed, having aspects of the present invention. The elliptical trainer 100 includes a flywheel 410, a crank wheel 412, a drive belt 414, a mounting plate 416, a frame 418, an electromagnetic resistance module 420, an electronic control unit 430, a power cable 432, and a data cable 434.

The mounting plate 416 is mechanically coupled to the frame 418. The flywheel 410 is rotatably connected to the mounting plate 416. The crank wheel 412 is rotatably connected to the frame 418. When the elliptical trainer 100 is fully assembled, the crank wheel 412 is mechanically coupled to the crankshaft 124 (not pictured). The drive belt 414 connects the crank wheel 412 to the flywheel 410, such that rotational energy of the crank wheel 412 is transmitted to the flywheel 410. Preferably, the drive belt 414 is connected to an outer circumference of the crank wheel 412, and the drive belt 414 is connected to an inner circumference of the flywheel 410. The electromagnetic resistance module 420 is mechanically coupled to the mounting plate 416. The electromagnetic resistance module 420 is electromagnetically coupled to the flywheel 410. The electronic control unit 430 is mechanically coupled to the frame 418. The electronic control unit 430 is in electrical communication with the electromagnetic resistance module 420. The power cable 432 is electrically connected to the electronic control unit 430. The data cable 434 is in electric communication with the electronic control unit 430.

In operation, the elliptical motion of the right and left footplates 122 and 132 causes the crankshaft 124 to rotate. The rotational energy of the crankshaft 124 is transmitted to the crank wheel 412, which then transmits the rotational energy to the flywheel 410 through the drive belt 414. While the user is exercising, electricity is provided to the electronic control unit 430 through the power cable 432. The electronic control unit 430 transmits a portion of this electricity to the electromagnetic resistance module 420, which produces an electromagnetic field near the flywheel 410. The electromagnetic field produced by the electromagnetic resistance module 420 creates drag on the flywheel 410, increasing the amount of rotational energy required by the crank wheel 412 to rotate the flywheel 410. Thus, as the electromagnetic field produced by the electromagnetic resistance module 420 is increased, the resistance at the crankshaft 124 is increased, and thus at the right and left footplates 122 and 132, is increased. Consequently, increasing the electromagnetic field increases exercise difficulty. The strength of the electromagnetic field produced by the electromagnetic resistance module 420 can be controlled by the user, preferably by operating the display console 210. The display console 210 then transmits data to the electronic control unit 430 of the elliptical trainer 100. The electronic control unit 430 then increases or decreases footplate resistance, as desired by the user.

Preferably, the flywheel 410 is heavy, having a large moment of inertia. In a preferred embodiment, the flywheel is approximately 40 pounds. A flywheel with a large moment of inertia compensates for the discontinuous force applied to the right and left footplates 122 and 132 by the user's feet, making operation of the elliptical trainer smooth and even and improving the overall user experience.

Figure 5:
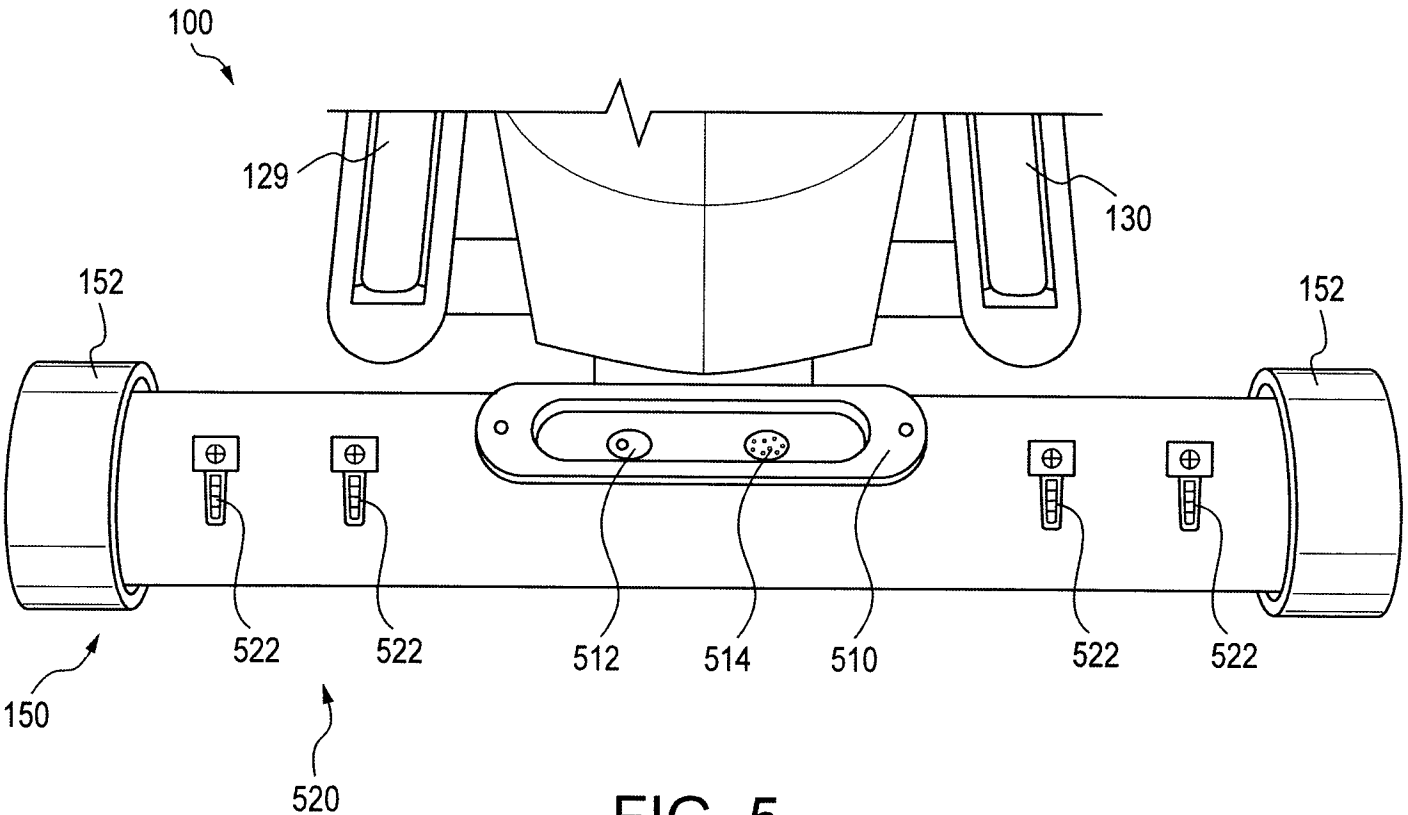
FIG. 5 illustrates the front portion of an elliptical trainer.

FIG. 5 illustrates the front portion of an elliptical trainer 100 having aspects of the present invention. The elliptical trainer 100 includes an interface 510, a power port 512, a data port 514, and a cable management system 520. The cable management system 520 includes cable ties 522.

The interface 510 is mechanically coupled to the transport assembly 150. The power port 512 is mechanically coupled to the interface 510. The data port 514 is mechanically coupled to the interface 510. The cable ties 522 are mechanically coupled to the transport assembly 150. The power port 512 is in electrical connection with the power cable 432. The data port 514 is in electrical communication with the data cable 434.

In operation, the power port 512 is connected to an external power source with an external power cable. The elliptical trainer 100 is then connected to the display console 210 with an external data cable through the data port 514. Preferably, the external power cable and/or the external data cable are secured by the cable ties 522. Once the user begins to operate the elliptical trainer 100, exercise data, such as RPM and wattage, are transmitted from the electronic control unit 430, through the data port 514, to the display console 210. Additionally, user preferences, such as the desired resistance setting, are transmitted from the display console 210, through the data port 514, to the electronic control unit 430, which then adjusts the electromagnetic field produced by the electromagnetic resistance module 420.

In an alternative embodiment, the interface 510 is a wireless data interface, and exercise data, as well as user preferences, are transmitted wirelessly between the interface 510 and the display console 210. Alternatively, data is transmitted wirelessly between the electronic control unit 430 and the display console 210. The interface 510 is preferably located on the transport assembly 150. However, in another embodiment, the interface 510 is located on the body 140 of the elliptical trainer 100. In yet another embodiment, the interface 510 is located on the seat assembly 110 of the elliptical trainer 100. In yet another embodiment, the interface 510 is located on the electronic control unit 430, and the interface 510 wireless transmits and wirelessly receives data.

Rotational energy of the flywheel 410 produced during exercise may be partially converted into electrical energy. This electrical energy is then supplied to the electronic control unit 430. In another embodiment, this electrical energy is supplied to the display console 210.

In a preferred embodiment, the mechanical components of the elliptical trainer, such as, for example, the mechanical components shown in FIG. 4, are located in front of, as opposed to under, the seat. Preferably, the mechanical components of the elliptical trainer are not under the seat, and are not behind the seat. In the low step height embodiment, the user is not required to "climb" onto his or her seat, but can instead sit down on the seat as he or she would sit down on a typical office chair. Thus, the low step height design enables less mobile persons, such as elderly or obese persons, to more easily position themselves on the integrated exercise workstation. Additionally, this design permits the seat assembly and table assembly to be positioned closer to the operating surface 170, reduces clutter around the user's seat, and prevents the large body of the elliptical trainer from otherwise obstructing movement near the seat assembly.

The height of the lowest point between the seat and the footplates of the low step height integrated exercise workstation is at most 10 inches. This low step height enables an individual to more easily step on and off the integrated exercise workstation. Preferably, the height of the lowest point between the seat and the footplates is at most 6 inches. Even more preferably, the height of the lowest point between the seat and the footplates is at most 2 inches.

In a low step height embodiment of the integrated exercise workstation, the mechanical components of the elliptical trainer, including the flywheel, the crankshaft, the electromagnetic resistance module, and the right and left footplates are positioned in front of the user when the user is seated on the seat assembly. Preferably, the mechanical components are positioned at least partially underneath the surface of the table assembly. Even more preferably, the mechanical components are integrated with the table assembly. Preferably, the seat assembly, which may include the components of a standard office chair, is connected to the table assembly or elliptical trainer. This connection ensures that the user remains at a constant distance from the footplates during exercise and is not pushed away from the elliptical trainer during exercise. Furthermore, the rotational position of the office chair is fixed, to prevent it from swiveling during operation of the elliptical trainer. Preferably, this connection is an adjustable track, which extends from the elliptical device to the seat assembly, along which the seat assembly can slide. This adjustable track includes a distance toggle, which allows the user to easily adjust the distance from the seat assembly to the footplates.

In one embodiment, to reduce the cost of the integrated exercise workstation, the height of the surface of the table assembly is fixed, and the user can instead adjust the height of his or her seat and/or the height of the footplates of the elliptical trainer. In another embodiment, the integrated exercise workstation is compatible with third party office chairs, which can be attached to the table assembly and/or elliptical trainer. For example, in one embodiment, a wire harness extends from the table assembly and attaches to the office chair. In another embodiment, a track extends from the table assembly and attaches to the office chair.

Figure 6:
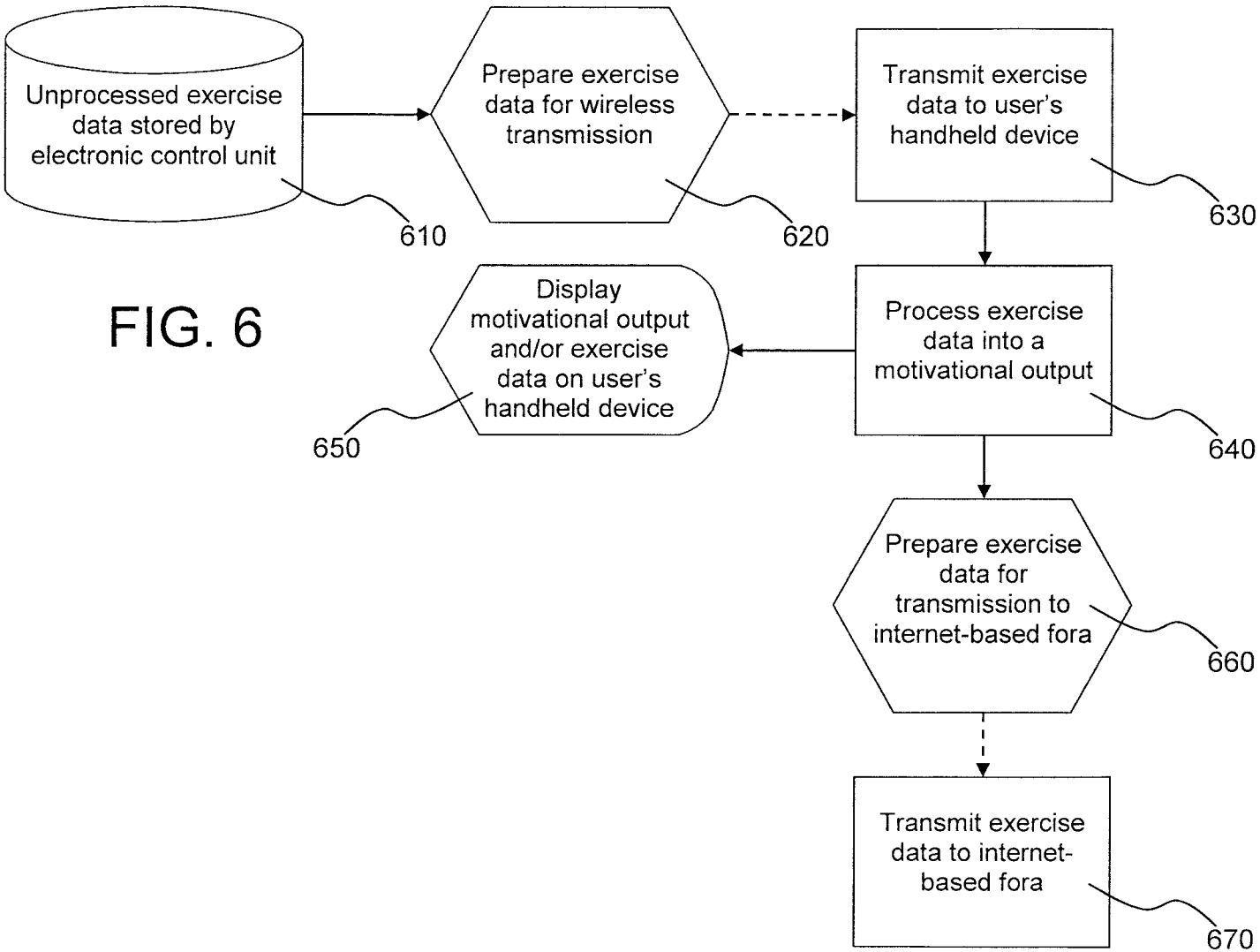
FIG. 6 illustrates a flow chart for the wireless transmission of exercise data.

FIG. 6 illustrates a flow chart for the wireless transmission of exercise data; this method may be implemented using a computer program product. First, unprocessed exercise data is stored by the electronic control unit 610. The exercise data is then prepared for wireless transmission 620 and transmitted to the user's handheld device 630. Next, the exercise data is processed into a motivational output 640. This motivational output and/or exercise data is displayed on the user's handheld device 650. Finally, the exercise data is prepared for transmission to internet-based fora 660, and the exercise data is transmitted to the internet-based fora 670.

In a preferred embodiment, the user's exercise data, including, for example, time elapsed, time exercised, exercise level at various times, resistance at various times, exercise speed at various times, heart rate at various times, calories burned at various times, and metabolic equivalents at various times, are stored in a memory of the electronic control unit 430 and can be transmitted wirelessly to a handheld device, such as a mobile telephone or a dedicated receiving device. This receiving device is equipped with hardware and software which stores the user's exercise data and/or processes the exercise data into a motivational output. Exercise data may be stored and processed for each individual user or for third parties, such as an authorized physician and/or a health insurance company.

The motivational output may include a graphical representation of exercise parameters, for example, the average weekly number of calories burned in the past three months. Additionally, the motivational output may include processed exercise data, such as, for example, the amount of weight the user would have lost during the previous week, assuming constant caloric intake. The motivational output may also include a food allotment, such as, for example, the number of additional hamburgers or chocolate bars the user may consume, without weight gain, given the number of calories burned during exercise.

The processed and unprocessed exercise data may be prepared in a manner which allows the user to easily share his or her progress on internet-based fora, such as TWITTER™, MYSPACE™, FACEBOOK™, or blogs. By sharing exercise data with a social network, the user gains additional motivation to lose weight and/or to improve his or her overall physical health.

Figure 7:
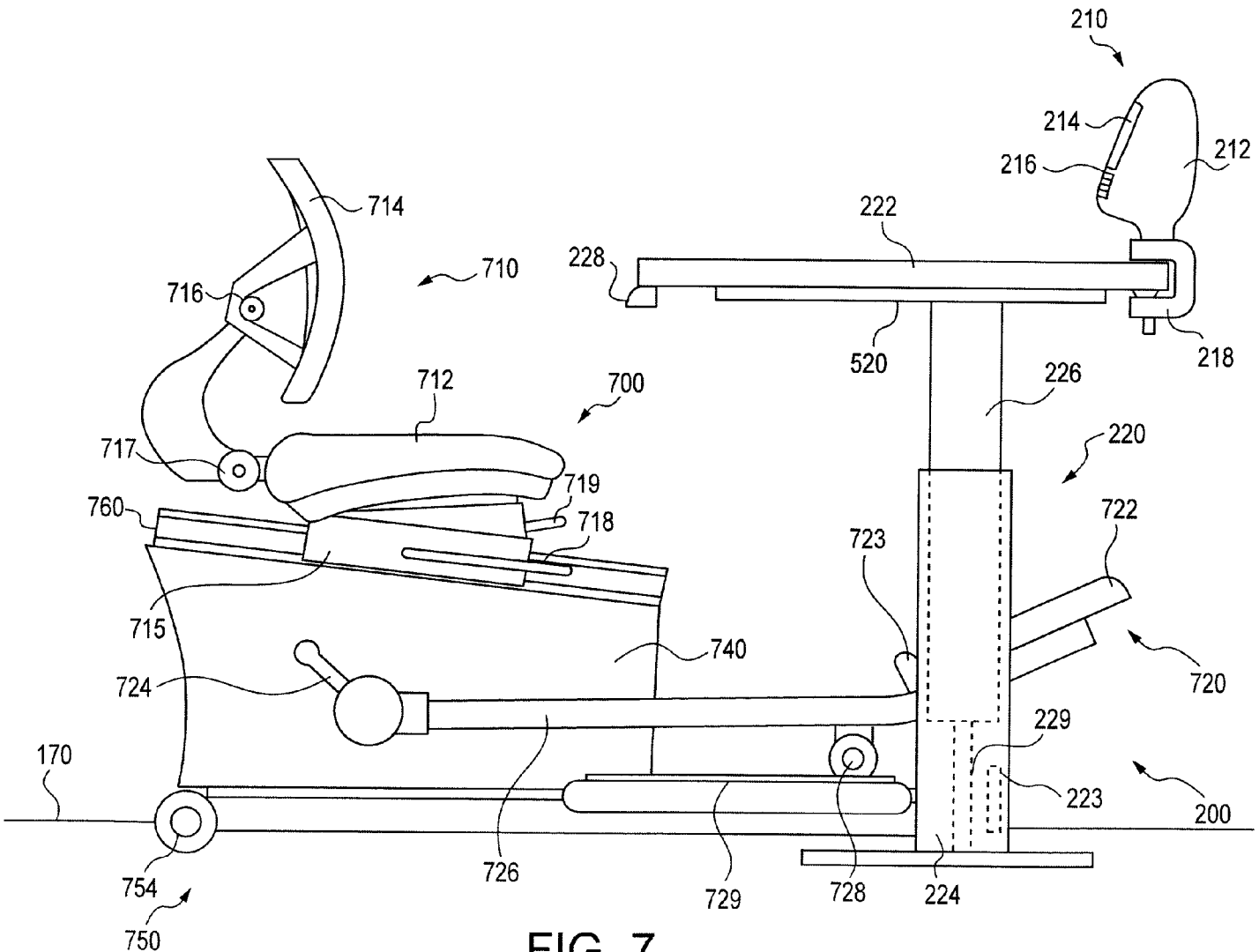
FIG. 7 illustrates an alternative embodiment of an integrated exercise workstation.

FIG. 7 illustrates an embodiment of the low step height design having aspects of the present invention. The elliptical trainer 700 includes a seat assembly 710, right and left elliptical foot assemblies 720 and 730, a body 740, a transport assembly 750, and a slide rail 760. The seat assembly 710 includes a seat cushion 712, a seat back 714, a rail assembly 715, an angle pivot 716, a depth pivot 717, a distance toggle 718, and a depth toggle 719. The right elliptical foot assembly 720 includes a right footplate 722, a right rear lip 723, a crankshaft 724, a right rocker 726, a right pivot wheel 728, and a right wheel guide 729. The transport assembly 750 includes front transport wheels 752 and rear transport wheels 754.

The seat cushion 712 is mechanically coupled to the rail assembly 715. The seat back 714 is pivotably connected to the seat cushion 712 by the angle pivot 716 and the depth pivot 717. The rail assembly 715 is slidably connected to the slide rail 760. The distance toggle 718 is mechanically coupled to the rail assembly 715 and the slide rail 760. The depth toggle 719 is mechanically coupled to the depth pivot 717. The right footplate 722 is mechanically coupled to the right rocker 726. The right rocker 726 is rotatably connected to the crankshaft 724. The right pivot wheel 728 is mechanically coupled to the right rocker 726. The right pivot wheel 728 is in contact with the right wheel guide 729. The left footplate 732 is mechanically coupled to the left rocker 736. The left rocker 736 is rotatably connected to the crankshaft 724. The left pivot wheel 738 is mechanically coupled to the left rocker 736. The left pivot wheel 738 is in contact with the left wheel guide 739. The front and rear transport wheels 752 and 754 are rotatably connected to the body 740 and are in contact with an operating surface 170. The slide rail 760 is mechanically coupled to the body 740.

Figure 8:
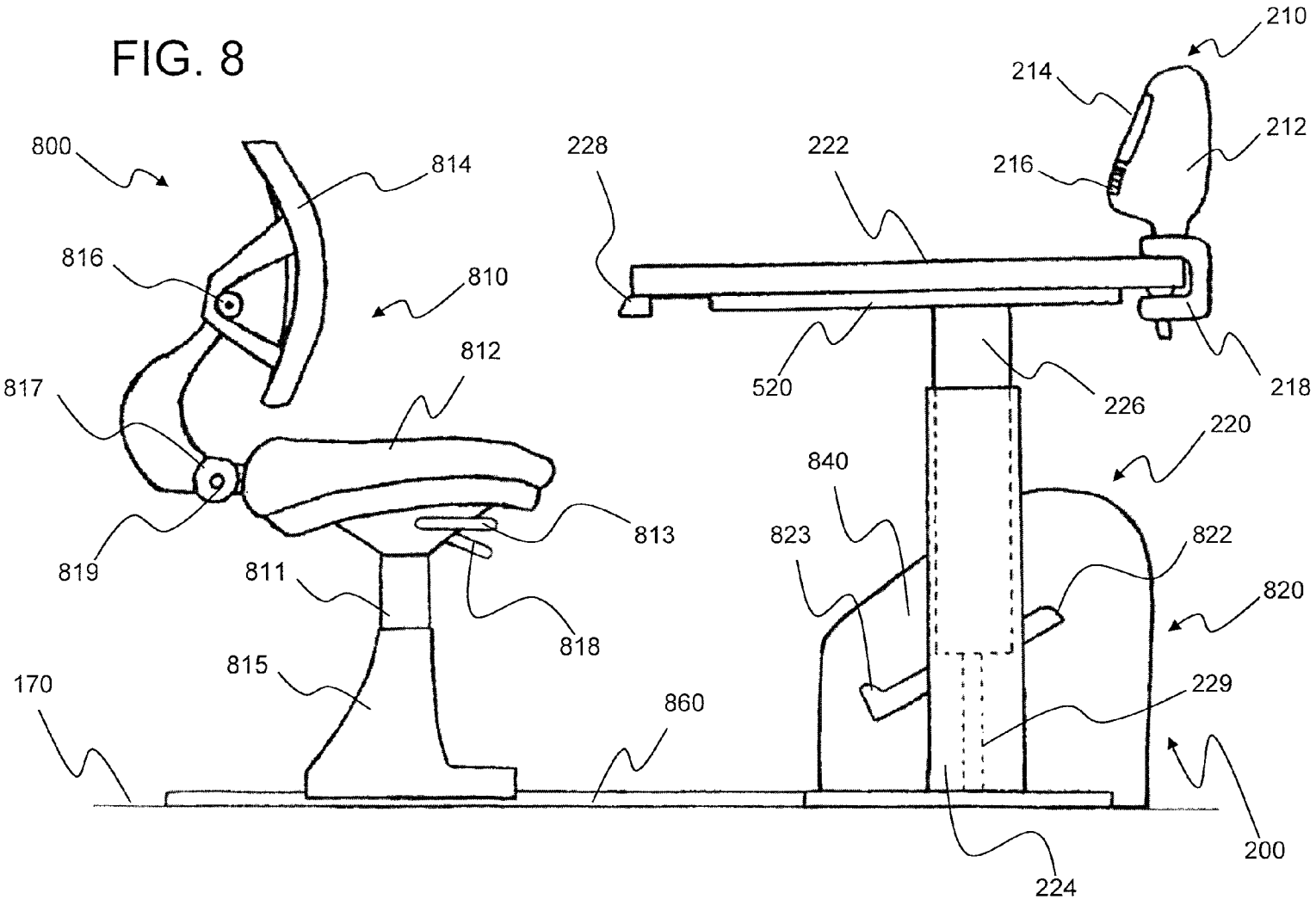
FIG. 8 illustrates a low step height integrated exercise workstation.

FIG. 8 illustrates an embodiment of the low step height design of an integrated exercise workstation 800 having aspects of the present invention. The integrated exercise workstation 800 includes a seat assembly 810, an elliptical foot assembly 820, and a distance track 860. The seat assembly 810 includes a seat cushion 812, a seat back 814, a pedestal 815, an angle pivot 816, a depth pivot 817, a distance toggle 818, a depth toggle 819, a height cylinder 811, and a height toggle 813. The elliptical foot assembly 820 includes a right footplate 822, a right rear lip 823, a left footplate with a left rear lip (hidden in illustration), and an elliptical assembly body 840.

The seat cushion 812 is mechanically coupled to the height cylinder 811. The seat back 814 is pivotably connected to the seat cushion 812 by the angle pivot 816 and the depth pivot 817. The depth toggle 819 is mechanically coupled to the depth pivot 817. The height toggle 813 is mechanically coupled to the height cylinder 811. The height cylinder 811 is mechanically coupled to the pedestal 815. The pedestal 815 is slidably connected to the distance track 860. The distance track 860 is mechanically coupled to the elliptical foot assembly 820. The right and left footplates are mechanically coupled to the elliptical assembly body 840. The distance track 860 is in contact with an operating surface 170.

In operation, the seat back 814 pivots about the angle pivot 816 in order to adjust the angle of the seat back 814. The distance toggle 818 allows the user to control the distance from the seat cushion 812 to the right and left footplates. When the user pulls the distance toggle 818 in a counterclockwise motion, the pedestal 815 slides freely along the distance track 860. Once the user releases the distance toggle 818, the pedestal 815 locks into one of a series of positions along the distance track 860. The depth toggle 819 allows the user to control the depth of the seat cushion 812 by controlling the position of the seat back 814 relative to the seat cushion 812. When the user pulls the depth toggle 819 in a counterclockwise motion, the seat back 814 and angle pivot 816 freely rotate about the depth pivot 817. Once the user releases the depth toggle 819, the position of the seat back 814 with respect to the seat cushion 812 becomes fixed. The height toggle 813 allows the user to control the height of the seat cushion 812 with respect to the operating surface 170 independently of the distance to the right and left footplates. When the user pulls the height toggle 813 in a counterclockwise motion, the height cylinder 811 slides freely with respect to the pedestal 815, allowing the user to raise or lower the position of the seat cushion 812. Once the user releases the height toggle 813, the height of the seat cushion 812 becomes fixed.

In a preferred embodiment, height adjustments of the seat cushion 812 are accomplished with a pneumatic height assembly located within the height cylinder 811. In another embodiment, height adjustments of the seat cushion 812 are accomplished with an electric motor located within the pedestal 815 or located within the height cylinder 811. In order to prevent the seat cushion 812 from bouncing up and down upon the pneumatic height assembly during operation of the elliptical trainer, the height of the seat cushion 812 preferably can be locked into place, for example, with a bolt and bracket assembly.

During operation of the elliptical foot assembly 820, the user's feet, placed upon the right and left footplates 822 and 832, move in an elliptical motion. Preferably, this elliptical motion is an elliptical motion in which the horizontal component of the motion is greater than the vertical component of motion.

In another embodiment, the elliptical assembly body 840 is slidably connected to the distance track 860, allowing for adjustment of the position of the elliptical assembly body 840 with respect to the table assembly 220. In such an embodiment, the elliptical assembly body 840 can be moved closer to or further from the seat cushion 812, without changing the distance from the seat cushion 812 to the table assembly 220.

REFERENCE

1. "Non-Exercise Activity Thermogenesis," available at http://mayoresearch.mayo.edu/levine_lab/about.cfm.

What is claimed is:

1. An exercise workstation, comprising:

a table assembly, having a working surface; and an elliptical trainer, comprising:

a frame;

a seat, coupled to the frame;

a crank wheel, rotatably coupled adjacent the rear end of the frame; and two foot assemblies, each foot assembly comprising a rocker, capable of pivoting at a point between a first end and a second end opposite the first end, and coupled to the crank wheel at the first end, and a footplate, coupled to the second end, and capable of elliptical motion about an axis having a horizontal component of motion greater than a vertical component of motion;

wherein a first distance between the seat and the table assembly is adjustable, a second distance between the seat and the axis is adjustable, the first distance and the second distance are independently adjustable, the elliptical trainer is a recumbent or semi-recumbent elliptical trainer, the working surface is substantially horizontal, and the foot assemblies can be operated when positioned beneath the working surface.

2. The exercise workstation of claim 1, wherein a height of the working surface is adjustable.

3. The exercise workstation of claim 1, wherein a height of the seat is adjustable, and the height of the seat and the second distance are independently adjustable.

4. The exercise workstation of claim 1, wherein a seat depth is adjustable.

5. The exercise workstation of claim 2, wherein the table assembly is an electric height adjustable table.

6. The exercise workstation of claim 1, wherein the seat comprises a non-electrostatic fabric.

7. The exercise workstation of claim 6, wherein the non-electrostatic fabric is conductive.

8. The exercise workstation of claim 1, further comprising a display console, wherein the display console is not mounted on the elliptical trainer.

9. The exercise workstation of claim 8, wherein the display console is mounted on the table assembly.

10. The exercise workstation of claim 8, wherein the display console wirelessly receives exercise data from the elliptical trainer.

11. The exercise workstation of claim 10, wherein the display console is a handheld device.

12. The exercise workstation of claim 1, wherein the table assembly further comprises a cross support, and the cross support is at most 18 inches above the operating surface.

13. The exercise workstation of claim 12, wherein the cross support is at most 12 inches above the operating surface.

14. The exercise workstation of claim 1, wherein the working surface has an area of at least 400 square inches.

15. The exercise workstation of claim 1, wherein the working surface has an area of at least 1600 square inches.

16. The exercise workstation of claim 1, further comprising a cable management system.

17. A method of performing exercise by a user, comprising:

exercising at the exercise workstation of claim 1; and performing office work;

wherein the exercising and the performing occur simultaneously for at least two hours within a ten hour period, and a highest heart rate achieved during the exercising is at most 60 percent of a maximum heart rate of the user.

18. The method of claim 17, wherein the working surface is located at or near the elbow level of the user, when arms of the user are resting vertically at sides of the user.

19. The method of claim 17, wherein the exercise workstation further comprises a chair, and the chair comprises the seat.

20. The exercise workstation of claim 1, further comprising a chair, wherein the chair comprises the seat.

* * * * *